US007032490B2

(12) United States Patent
Lee

(10) Patent No.: US 7,032,490 B2
(45) Date of Patent: Apr. 25, 2006

(54) HOLE PUNCH

(75) Inventor: Pei-Yuan Lee, Taipei (TW)

(73) Assignee: Primax Electronics Ltd., Taipei (TW)

( * ) Notice: Subject to any disclaimer, the term of this patent is extended or adjusted under 35 U.S.C. 154(b) by 44 days.

(21) Appl. No.: 10/709,053

(22) Filed: Apr. 9, 2004

(65) Prior Publication Data

US 2005/0223866 A1 Oct. 13, 2005

(51) Int. Cl.
*B26D 5/08* (2006.01)

(52) U.S. Cl. ..... 83/622; 83/588; 83/619

(58) Field of Classification Search ..... 83/622, 83/619, 588, 627, 628, 620, 582
See application file for complete search history.

(56) References Cited

U.S. PATENT DOCUMENTS 767,914 A * 8/1904 Phillippi ..... 83/622
3,227,023 A * 1/1966 Bouvier ..... 83/549
4,125,045 A * 11/1978 Jeremic ..... 83/389
4,509,397 A * 4/1985 Mori et al. ..... 83/453
4,742,744 A * 5/1988 Lindberg ..... 83/167
5,044,242 A * 9/1991 Chiang ..... 83/549
5,069,097 A * 12/1991 Mori ..... 83/56
5,463,922 A 11/1995 Mori

* cited by examiner

*Primary Examiner*—Charles Goodman
(74) *Attorney, Agent, or Firm*—Winston Hsu

(57) ABSTRACT

A hole punch has a length in a first direction, a plurality of punch blocks each having a sinusoidal first guide surface, a slider movable along a frame in the first direction, and a roller connected to the slider at a position to engage the first guide surface of each punch block. Each punch block is fixed in the frame in the first direction and is moveable in the frame in a second direction perpendicular to the first direction. Each punch block also includes at least a punch head facing the second direction, and a retracting mechanism for urging the punch block in opposite the second direction to an initial position. When the slider moves in the first direction along the frame, the roller pushes the first guide surface near the middle of the punch block moving the punch block in the second direction to punch holes.

15 Claims, 8 Drawing Sheets

HOLE PUNCH

BACKGROUND OF INVENTION

1. Field of the Invention

The present invention relates to a hole punch, and more specifically, to a punch for making a plurality of holes in a medium such as paper.

2. Description of the Prior Art

Hole punches are common devices found in offices, schools, and homes. Hole punches serve to punch or cut holes into one or more sheets of paper. The result is that the punched paper can then be stored in a binder or bound by some other means.

The working principle of the common three hole punch is straightforward. A lever arm is hinged to a base, and three hole punch heads are connected to the lever arm. When a user presses down on the lever, the three hold punch heads are driven into receptacles in the base thereby cutting holes into paper placed on the base. Such a hole punch is suitable for light use; since the holes are punched simultaneously and by human effort, this type of punch is limited in the number of holes and in the number of sheets of paper that can be punched.

One notable improvement in the basic hole punch is taught by Mori in U.S. Pat. No. 5,463,922, which is included herein by reference. Mori's punch is capable of cutting a large number of holes into several sheets of paper. Briefly, referring to FIG. 1, a slide rail 11 has a multiplicity of pairs of first slots 15. Each pair of first slots 15 is provided for supporting an actuator pin 13 for actuating a cutting tool 17. A slider 14 is fitted on the slide rail 11 and is slidable along it to engage the actuator pins 13 and thereby lower the cutting tools one after another to make a line of holes in paper. The slider 14 has an arch-shaped cross section to fit slidably over the slide rail 11 and has an inner surface provided with an upper guide surface 143 and a lower guide surface 144 which define a guide groove in which the actuator pins 13 are engageable to move the cutting tools 17 vertically. When the slider 14 is slid along the rail 11, the guide surfaces 143, 144 move the actuator pins 13 driving the cutting tools down and up.

While Mori's hole punch is one solution of how to cut a large number of holes into several sheets of paper, it suffers from several drawbacks. First, for each hole to be cut, there is one moving cutting tool 17. Thus for 30 holes, at least 30 separate moving parts are required, and with each moving part comes the risk of malfunction. Second, the actuator pins 13 are required to be small diameter, and are thus prone to breakage or to damaging the guide surfaces 143, 144. Given these two drawbacks, and more may be apparent to a skilled designer or user, there is a need for an improved hole punch.

SUMMARY OF INVENTION

It is therefore a primary objective of the claimed invention to provide a punch for making a plurality of holes in a medium such as paper to solve the above-mentioned problems of the prior art.

Briefly summarized, the claimed invention includes a frame having a length in a first direction, a plurality of punch blocks each having a first guide surface, a slider movable along the frame in the first direction, and a protrusion connected to the slider at a position to engage the first guide surface of each punch block. Each punch block is fixed in the frame in the first direction and is moveable in the frame in a second direction perpendicular to the first direction. The first guide surface faces opposite the second direction and spans from one end of the punch block to the other end along the first direction, being further in the second direction at the two ends of the punch block than at the middle of the punch block. Each punch block further comprises at least a punch head facing the second direction, and a retracting mechanism for urging the punch block in opposite the second direction to an initial position. When the slider moves in the first direction along the frame, the protrusion pushes the first guide surface near the middle of the punch block moving the punch block in the second direction.

It is an advantage of the claimed invention that more than one punch can be driven by a punch block, reducing the number of mechanical parts and likelihood of malfunction.

It is an advantage of the claimed invention that the first guide surface of the punch block and the protrusion can be made at a robust a scale to avoid damage to the punch.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
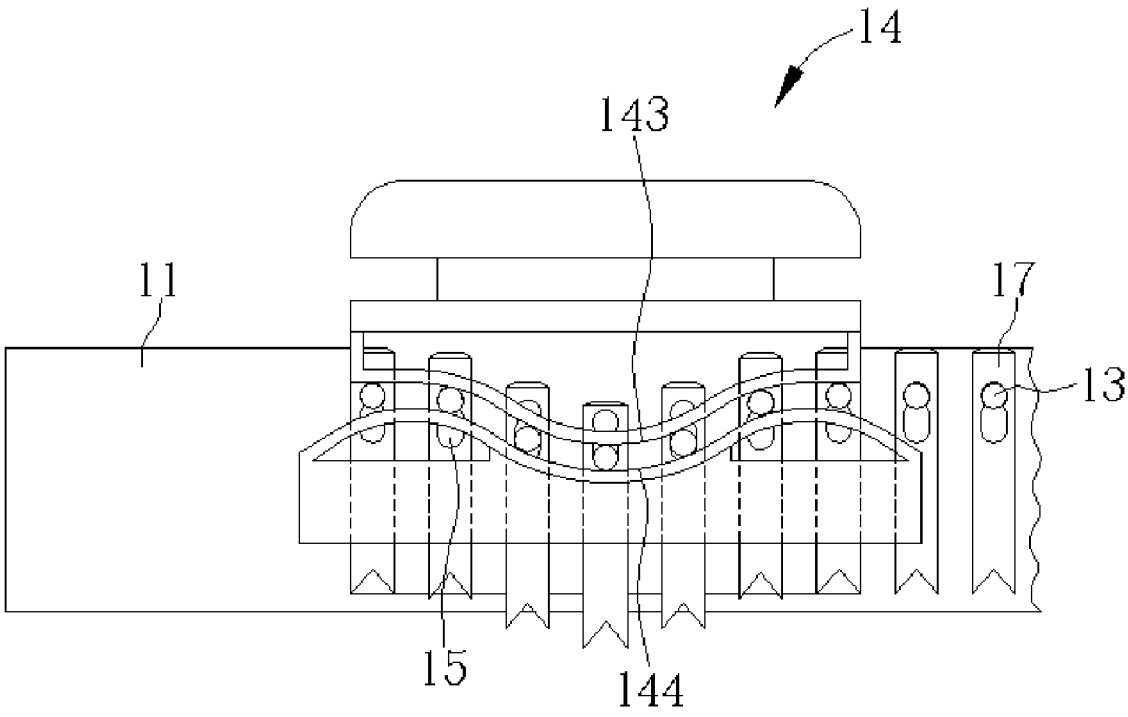
Fig. 1 Prior art
FIG. 1 is a schematic diagram of a prior art punch.
Figure 2:
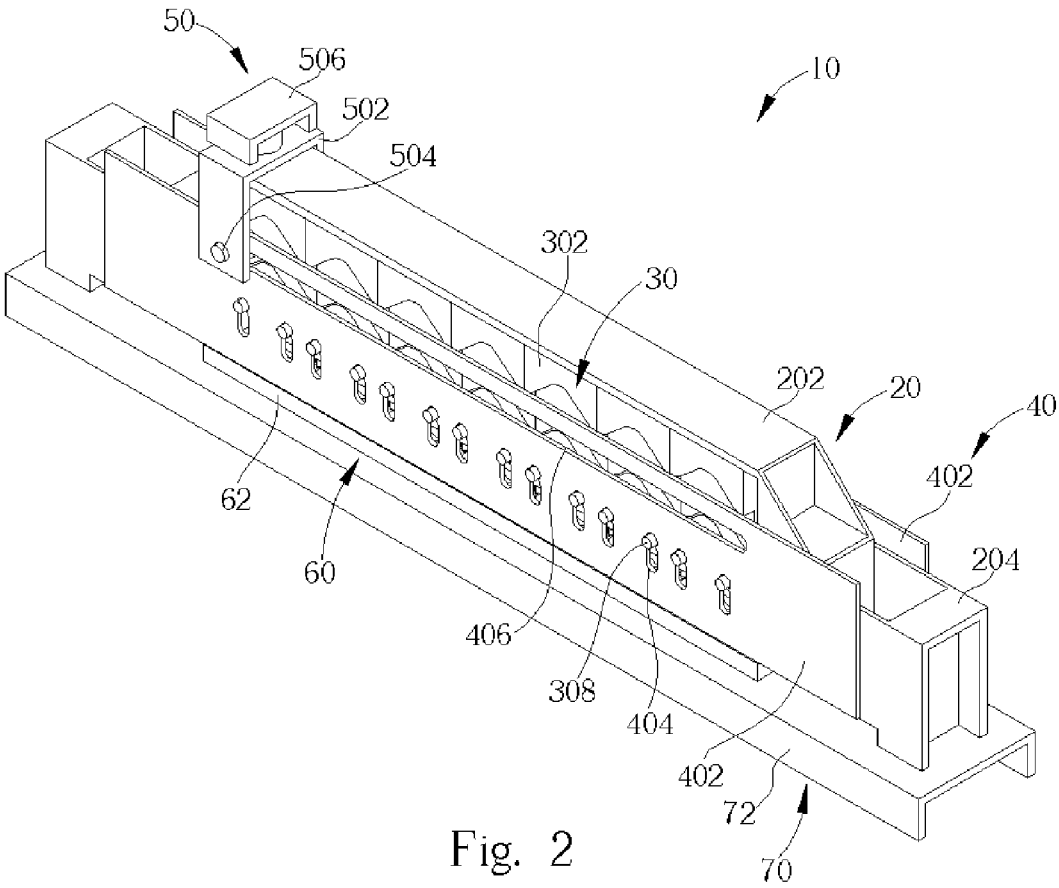
FIG. 2 is a perspective diagram of a punch according to the present invention.

Please refer to FIG. 2 illustrating a punch 10 according to the first embodiment of the present invention. The punch 10 includes a frame 20 inside which several punch blocks 30 are situated. The frame 30 is fastened to a base 70 so the punch blocks 30 are restricted from moving along the length of the frame 20. Attached to each side of the frame 20 are two side plates 40 for keeping the punch blocks 30 inside the frame 20 among other things (described later). Also provided is a slider 50 slidable along the frame 20, the slider 50 being held to the frame 20 and/or to the side plates 40 as necessary by straight guide grooves (not shown) or a similar well-know mechanism.

Figure 3:
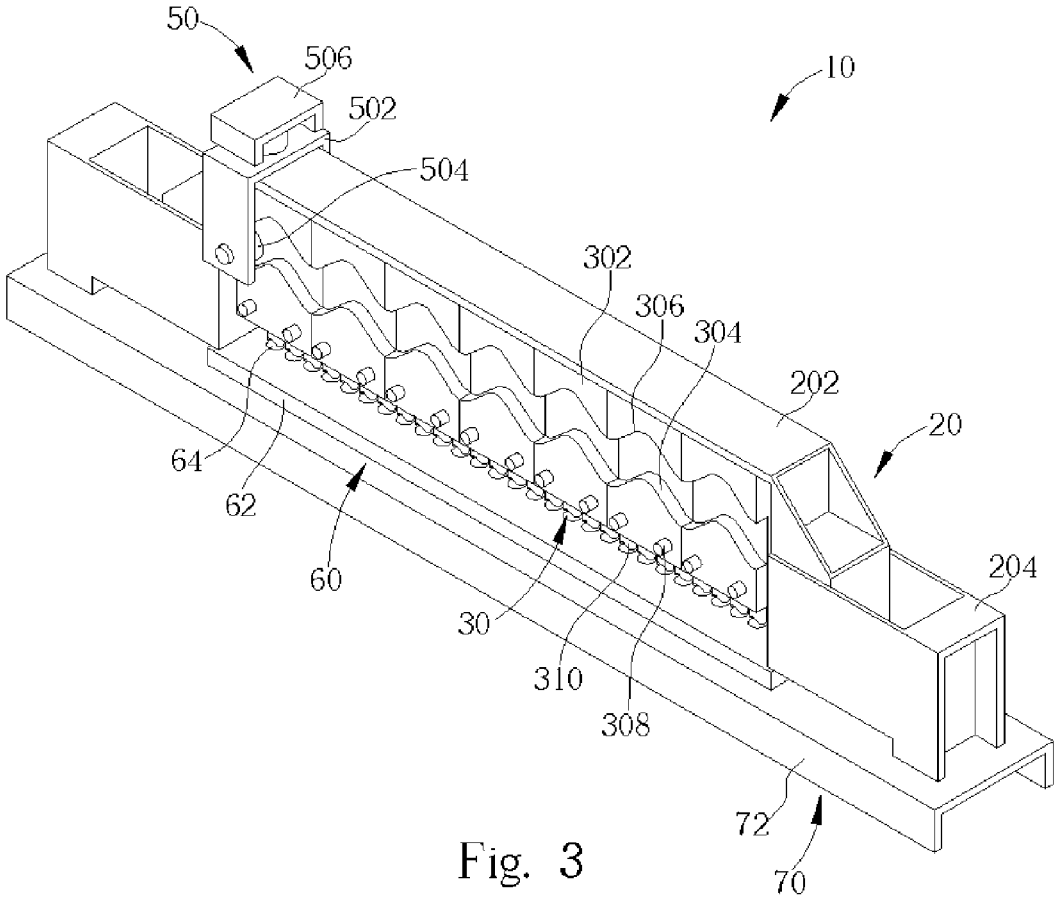
FIG. 3 is a perspective diagram of the punch of FIG. 2 with one side plate removed.

FIG. 3 illustrates the punch 10 with one side plate 40 removed. In FIG. 3, the punch blocks 30 are more visible.

Figure 4:
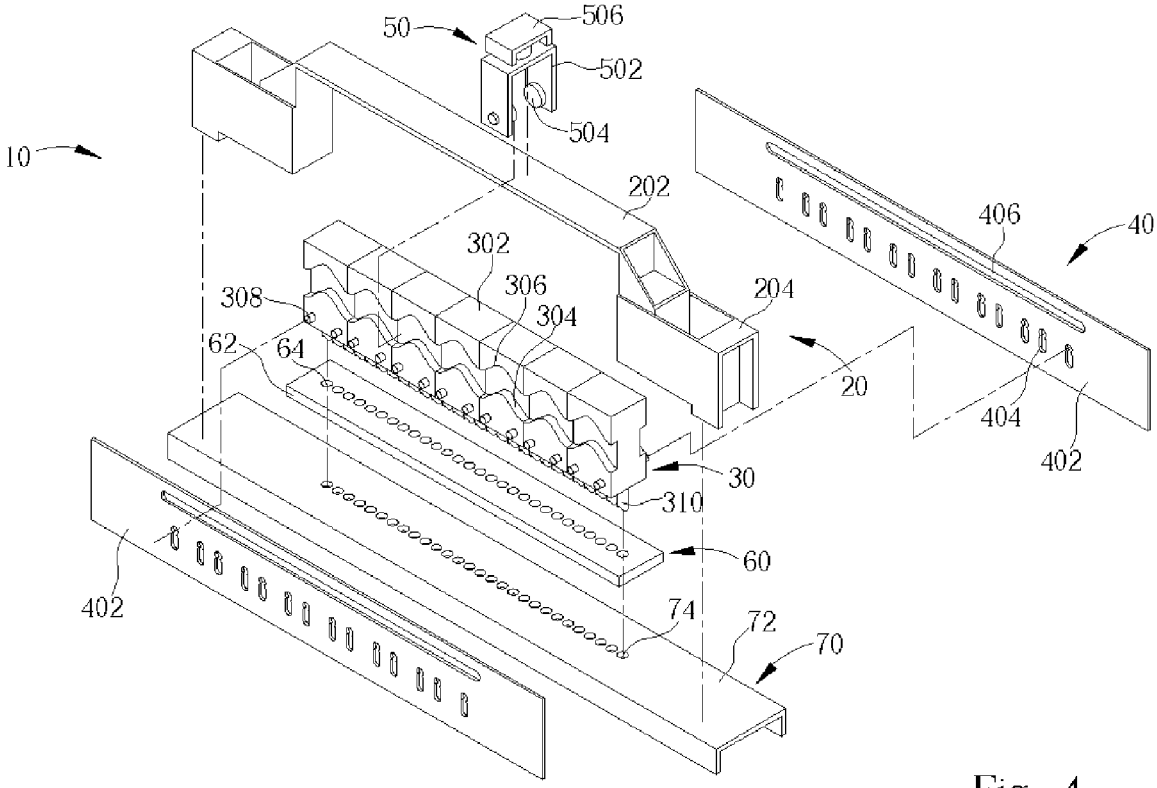
FIG. 4 is an exploded perspective diagram of the punch of FIG. 2.

Referring to FIG. 4, an exploded view of the punch 10, the frame 20 includes a rail 202 and two ends 204. The rail 202 provides a surface for the slider 50 to slide upon. The ends 204 serve to anchor the frame 20 to the base 70. The ends 204 need not be exactly as depicted, alternative structures are also suitable. The dimensions and precise shape of the frame 20 can be selected according to suitable mechanical properties of the materials used among other considerations, however, the length of the rail 202 should be selected considering the size of the medium to be punched, and the height of the ends 204 should be selected considering the height of the punch blocks 30 and the maximum thickness and quantity of the medium to be punched. The frame 20 could be metal or hard plastic.

Each punch block 30 comprises a block body 302 and a first guide surface 304 formed in the block body 302. The first guide surface 304 has a sinusoidal or hill-valley-like shape. Offset above the first guide surface 306 and having a corresponding shape is a second guide surface 306. First and second guide surfaces 304, 306 can have continuous curvature or be a made of a series of adjacent flat planes. The punch block 30 further includes four pins 308 (two on the reverse side not visible) protruding laterally from the block body 302, and four punch heads 310 protruding downward from the block body 302. The punch heads 310 are cutting tools, hole punch heads, or the like and are for cutting holes in the medium. In other embodiments, the quantities of the pins 308 and punch heads 310 can be changed (these quantities are independent), with minimum or maximum numbers being a design choice. The block body 302 can be made of any shape and material, and can be optimized for weight, material use, and manufacturing concerns. As one example, the entire punch block 30 could be hard plastic with the exception of the punch heads 310 being wear-resistant steel.

Each side plate 40 includes a plate 402 in which a plurality of slots 404 and a window 406 are punched, cut, or otherwise formed. The plate 402 can be made of metal or hard plastic. The slots 404 correspond to the pins 308 of the punch blocks 30. Each slot 404 has a slight constriction, or narrowed part, near the top which holds the pin 308 against the weight of the punch block 30. An external force is required to move the pin 308 (and thus the block 30) past the constriction into the remaining part of the slot 404 in which the pin 308 can freely move. The slots 404 of the slide plates 40 serve to hold each punch block 30 at the topmost part of its range—the initial position of the punch block 30 (described later).

The slider 50 includes a slider frame 502, a pair of rollers 504, and a handle 506. The frame 506 is formed in an overall U-shape to straddle and slide along the rail 202, although other shapes that accomplish this are also suitable. Each roller 504 is installed on an inside wall of the frame 502 and is positioned to engage with the first and second guide surfaces 304, 306 of each punch block 30 through the window 406 of the side plate 40. Though the roller 504 need not actually rotate, this helps in reducing wear to the guide surfaces 304, 306. The frame 502 is held to the rail 202 and/or side plates 40 by straight guide grooves (not shown for clarity) or similar well-know mechanism such that vertical movement of the rollers 504 is prevented. The height at which the roller 504 is located is selected so that the roller 504 applies substantially no force to either the first or second guide surface 304, 306 when the roller 504 is near the end of a punch block 30 (i.e. between two punch blocks 30) when the punch block 30 is in the initial position. The handle 506 of the slider 50 is located at the top of the frame 502 and is for a user to comfortably manually move the slider along the frame 20. The slider 50 may be made of metal or hard plastic.

The base 70 includes a base plate 72 and a plurality of holes 74. The plate 72 connects to the ends 204 of the frame 20 by preferably a removable fastening mechanisms such as bolting or clipping. The holes 74 line up with the punch heads 310 of the punch blocks 30 and are important to the cutting action of the particular type of punch head 310 described. Since other types of punch heads or cutting heads are suitable for use in the invention, the holes 74 in the base 70 may be omitted or changed to a suitable form, the base plate 72 serving essentially to provide a location for the stationary part of whatever cutting tools used. The base 70 is preferably made of metal, however hard plastic is also suitable.

In addition, a hole plate 60 is provided as shown in FIG. 4. The hole plate 60 includes a plate 62 punched with a plurality of holes 64. The holes 64 engage with the punch heads 310 regardless of the position of the punch block 30, so that the hole plate 60 serves to keep the punch blocks 30 properly aligned. The hole plate 60 is optional and is simply provided to improve the performance of the invention, and other types of cutting tools may preclude its use. The hole plate 60 can be made of metal or hard plastic.

Figure 5:
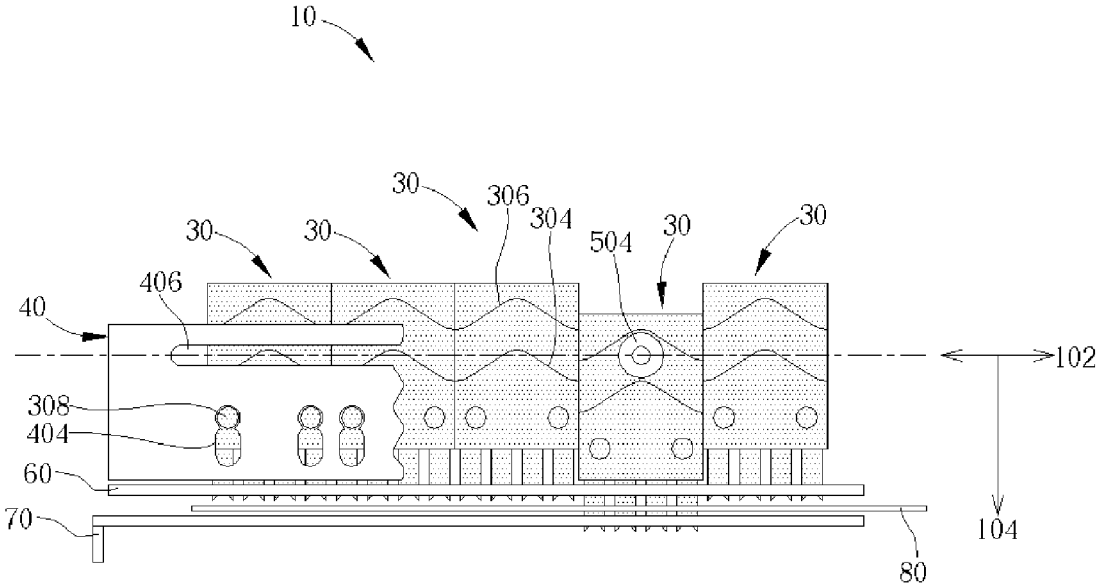
FIG. 5 is a schematic diagram of the operation of the punch of FIG. 2

Regarding the operation of the punch 10, please refer to FIG. 5. FIG. 5 illustrates a schematic of key parts of the invention. Also illustrated are arrows indicating a first direction 102 and a second direction 104, and paper 80 to be punched. The symmetry of the invention described above allows the first direction 102 to be bi-directional, meaning that either left or right on the page of FIG. 5 can be considered the first direction 102. When the user pushes the slider 50, the roller 504 is constrained to move along the dashed line in the first direction 102. The roller 504 enters the punch block 30 and contacts the first guide surface 304 thereby pushing the block 30 in the second direction 104. As the block 30 leaves the initial position, the pin 308 passes through the constriction of the slot 404 and enters the free-moving range of the slot 404. As the roller 30 leaves the punch block 30, it contacts the second guide surface 306 and pulls the block 30 back up to the initial position. As the block 30 returns to the initial position, the pin 308 passes through the constriction of the slot 404 causing the block 30 to be held in place. Thus, as the roller 30 traverses through all the blocks 30, it causes sets of holes (the size of a set determined by the number of punch heads 310 per block) to be punched into the paper 80.

Figure 6:
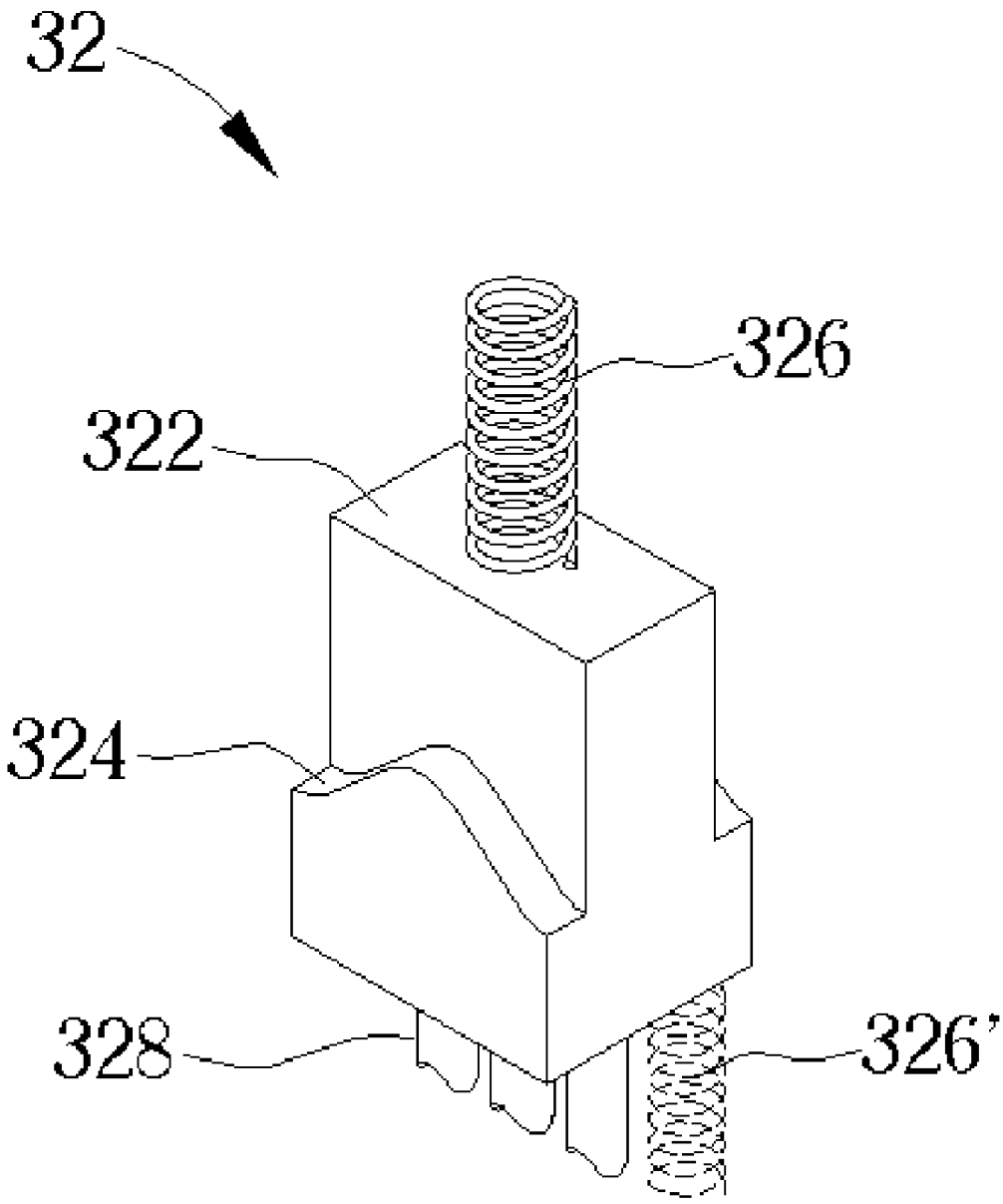
FIG. 6 is a perspective diagram of a second embodiment of the punch block of FIG. 2.

The second guide surface 306 and the pins 308 and slots 404 act as a retracting mechanism for the block 30. Other embodiments of the retracting mechanism are illustrated in FIGS. 6–9. FIG. 6 shows a block 32 without an upper guide surface or pins, the absence of pins allowing the slots 404 on the plate 402 to be omitted. The block 32 includes a block body 322, a lower first guide surface 324 formed in the block body 322, a coil spring 326, and three punch heads 328. The coil spring 326 is connected to the underside of the rail 202 (or similar structure) and provides the retracting action to the block 32. That is, the coil spring 326 tends to pull the block 32 opposite the second direction 104 (i.e. up). The coil spring can also be located below the block 32 as indicated by 326' so as to push the block 32 opposite the second direction 104. The coil spring 326 has the other end connected to the hole plate 60 or base 70. In other aspects, operation of a present invention punch including blocks 32 is the same as that of the punch 10.

Figure 7:
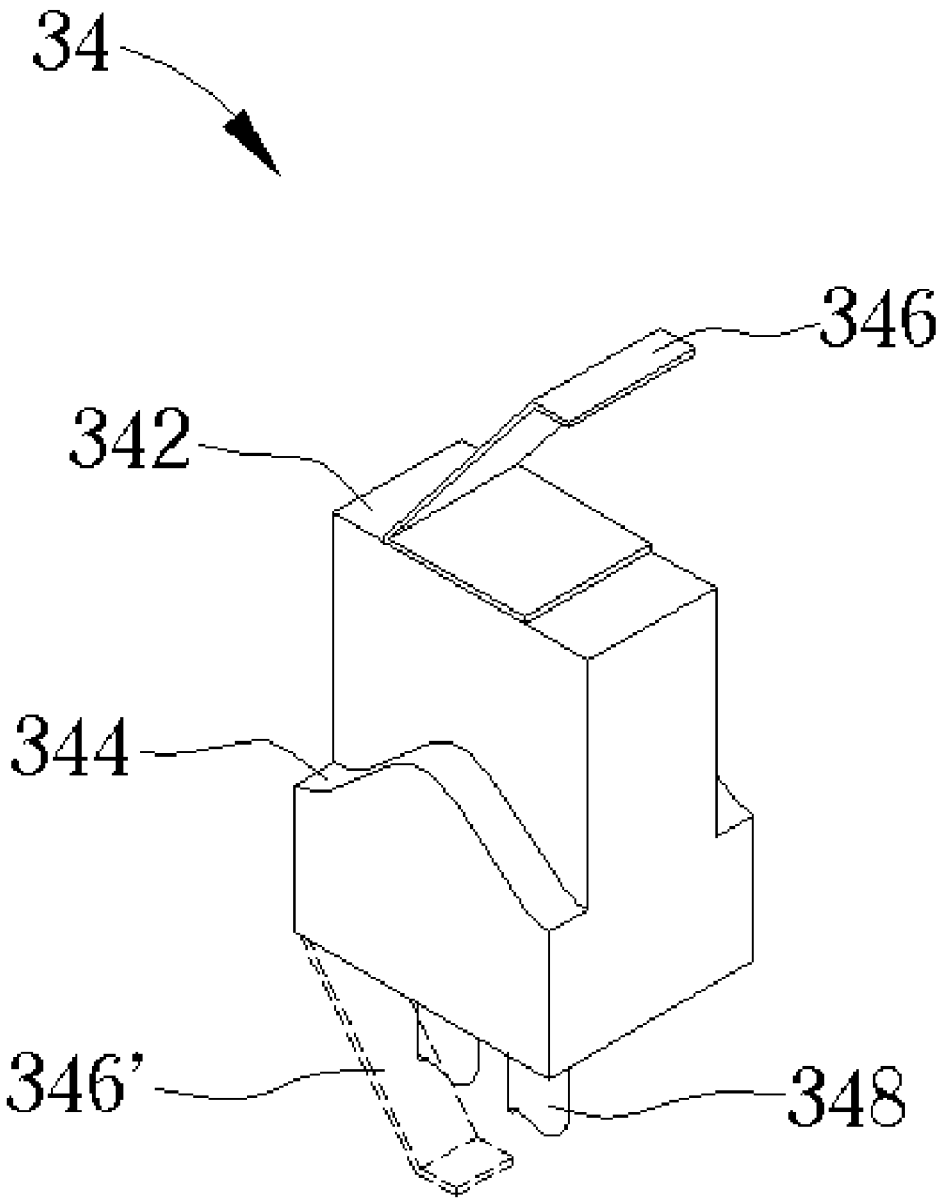
FIG. 7 is a perspective diagram of a third embodiment of the punch block of FIG. 2.

FIG. 7 illustrates another block 34 for use in the present invention punch. Like the block 32, the block 34 is without an upper guide surface or pins, the absence of pins allowing the slots 404 on the plate 402 to be omitted. The block 34 includes a block body 342, a lower first guide surface 344 formed in the block body 342, a flat spring 346, and two punch heads 348. The flat spring 346 is connected to the underside of the rail 202 (or similar structure) and provides the retracting action to the block 34. Specifically, the flat spring 346 tends to pull the block 34 opposite the second direction 104 (i.e. up). The flat spring can also be located below the block 34 as indicated by 346', having the other end connected to the hole plate 60 or base 70, so as to push the block 34 opposite the second direction 104. In other aspects, operation of a present invention punch including blocks 34 is the same as that of the punch 10.

Figure 8:
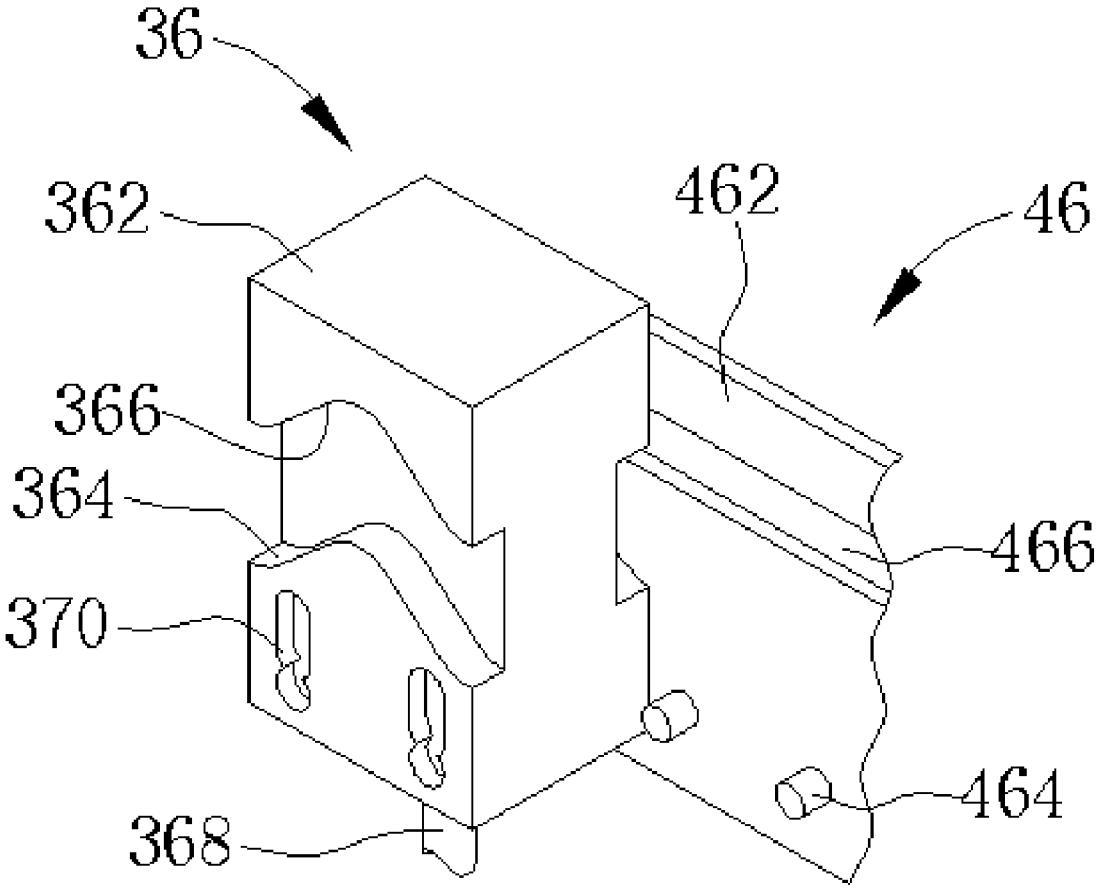
FIG. 8 is a perspective diagram of a fourth embodiment of the punch block and side plates of FIG. 2.

FIG. 8 illustrates another block 36 according to the present invention. The block 36 includes a block body 362, a first guide surface 364, a second guide surface 366, a single punch head 368, and slots 370. The slots 370 are for mating with pins 464 of a side plate 46, which is made of a plate 462 that includes a window 466. The block 36 and side plate 46 are similar to the block 30 and side plate 40 except that the locations of the pins and slots are reversed. Operation of a present invention punch including blocks 36 is the same as that of the punch 10.

As illustrated in the other embodiments of the block, the block used in the present invention can have any number of punch heads. In addition, the punch can be designed to punch any number of holes, which need not be uniform in spacing nor style/shape. The punch heads can also be designed to punch or cut appurtenances other than round holes. Moreover, the punch can be used to punch holes into any material, paper merely being an example. Other materials for which the punch is suited include textiles, plastic, thin metal, and cardboard. Additionally, the construction materials of the punch described above can be altered to suit manufacturing needs. For instance, the entire punch can be made of metal if desired. The shape of block 30 can be optimized as it depends on the manufacturing process and material used (i.e. the block shape can be made hollow or can be made with material-saving cavities). It should also be noted that any combination of one or more than one spring (coil, flat, or other) at any position relative to a punch block can be used to provide retracting action to the punch block, in lieu of the upper guide surface and associated pins and slots. Finally, although depicted as a cross-section-symmetrical device, the entire punch can be made in a half-section (as if split down the length about the axis of symmetry) with only trivial modifications apparent to anyone skilled in the art.

In contrast to the prior art, the present invention provides a punch block by which one or more punches can be driven, reducing the number of mechanical parts and the likelihood of malfunction. In addition, the first guide surface of the punch block and the protrusion (i.e. the roller) can be made at a robust a scale to avoid damage to the moving parts.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A punch for making a plurality of openings comprising:

a frame having a length in a first direction;

a plurality of punch blocks, each punch block fixed in the frame in the first direction and moveable in the frame in a second direction perpendicular to the first direction, each punch block comprising:

a first guide surface facing opposite the second direction, the first guide surface spanning from one end of the punch block to the other end along the first direction and being further in the second direction at the two ends of the punch block than at the middle of the punch block;

at least a punch head facing the second direction;

a retracting mechanism for urging the punch block in opposite the second direction to an initial position;

a slider movable along the frame in the first direction;

a protrusion connected to the slider at a position to engage the first guide surface of each punch block;

wherein when the slider moves in the first direction along the frame, the protrusion pushes the first guide surface near the middle of the punch block moving the punch block in the second direction.

2. The punch of claim 1 wherein the retracting mechanism comprises a second guide surface facing and separated from the first guide surface and of shape substantially mating with the first guide surface; wherein when the slider moves in the first direction along the frame, the protrusion pushes the second guide surface near an end of a punch block moving the punch block in opposite the second direction to the initial position.

3. The punch of claim 2 wherein the retracting mechanism further comprises a pin protruding from the punch block engaging with a slot formed in the frame, the slot being substantially in the second direction and having with a constriction offering resistance to translation of the pin to hold the punch block at the initial position when the protrusion is not pushing the first guide surface.

4. The punch of claim 2 wherein the retracting mechanism further comprises a slot formed in the punch block engaging with a pin protruding from the frame, the slot being substantially in the second direction and having with a constriction offering resistance to translation of the pin to hold the punch block at the initial position when the protrusion is not pushing the first guide surface.

5. The punch of claim 2 wherein each punch block is substantially symmetrical about a plane formed by the first and second directions, each punch block having two first and second surfaces; the punch comprising two protrusions, one for pushing each set of first and second guide surfaces.

6. The punch of claim 1 wherein the retracting mechanism comprises an elastic member connecting the punch block to the frame.

7. The punch of claim 6 wherein the elastic member is a flat spring or a coil spring.

8. The punch of claim 1 further comprising a base connected to both ends of the frame, a gap between the base and the frame for accommodating material to be cut by the punch heads.

9. The punch of claim 1 wherein the protrusion is a roller rotationally connected to the slider.

10. A punch for making a plurality of openings comprising:

a frame having a length in a first direction;

a plurality of punch blocks, each punch block fixed in the frame in the first direction and moveable in the frame in a second direction perpendicular to the first direction, each punch block comprising:

a guide groove spanning from one end of the punch block to the other end along the first direction and being further in the second direction at the two ends of the punch block than at the middle of the punch block;

at least a punch head facing the second direction;

a pin protruding from the punch block;

a slider movable along the frame in the first direction;

a roller connected to the slider at a position to engage the guide groove of each punch block;

a plurality of slots formed in the frame, each slot being substantially in the second direction and having with a constriction offering resistance to translation of the pin to hold the punch block at an initial position when the roller is not pushing the guide groove near the middle of the punch block; and a base connected to both ends of the frame, a gap between the base and the frame for accommodating material to be cut by the punch heads;

wherein when the slider moves in the first direction along the frame, the roller pushes the guide grove near the middle of the punch block moving the punch block in the second direction, and pushes the guide grove near the ends of the punch block moving the punch block in opposite the second direction.

11. The punch of claim 10 wherein each punch block is substantially symmetrical about a plane formed by the first and second directions, each punch block having two guide grooves; the punch comprising two rollers, one for engaging each of the guide grooves.

12. The punch of claim 11 wherein each punch block comprises four pins and the frame comprises four corresponding slots per punch block.

13. A punch for making a plurality of openings comprising:

a frame having a length in a first direction;

a plurality of punch blocks, each punch block fixed in the frame in the first direction and moveable in the frame in a second direction perpendicular to the first direction, each punch block comprising:

a means for receiving an actuation in the second direction;

at least a punch head facing the second direction;

a means for retracting the punch block in opposite the second direction to an initial position;

a means for engaging the means for the means for receiving an actuation for urging each punch block in the second direction.

14. The punch of claim 13 wherein each punch block is substantially symmetrical about a plane formed by the first and second directions.

15. The punch of claim 13 further comprising a base connected to both ends of the frame, a gap between the base and the frame for accommodating material to be cut by the punch heads.

* * * * *